United States Patent [19]

Strickland et al.

[11] 3,967,806

[45] July 6, 1976

[54] ADJUSTABLE APPARATUS FOR SUPPORTING CONCRETE FORMWORK

[75] Inventors: James K. Strickland; Frank J. Hessel; James W. Cote, all of Jacksonville, Fla.

[73] Assignee: Strickland Systems Inc., Jacksonville, Fla.

[22] Filed: Mar. 17, 1975

[21] Appl. No.: 558,648

[52] U.S. Cl. ..... 248/287; 249/219 R

[51] Int. Cl.[2] ..... A47F 5/10; A47H 33/00

[58] Field of Search ..... 248/287, 279, 285, 286, 248/298, 124; 249/219 R

[56] References Cited

UNITED STATES PATENTS

| | | | |
|---|---|---|---|
| 557,575 | 4/1896 | Gibson et al. | 248/279 X |
| 3,504,879 | 4/1970 | Strickland | 248/296 |
| 3,776,499 | 12/1973 | Turner | 249/219 R |
| 3,815,858 | 6/1974 | Mocny | 248/295 |
| 3,826,459 | 7/1974 | Warren | 248/295 X |
| 3,863,877 | 2/1975 | Kirk | 248/295 |
| 3,863,896 | 2/1975 | Hope et al. | 248/296 X |

*Primary Examiner*—J. Franklin Foss
*Attorney, Agent, or Firm*—Schuyler, Birch, Swindler, McKie & Beckett; McKie & Beckett

[57] ABSTRACT

Apparatus for supporting concrete formwork used in construction of multi-story concrete buildings, including a formwork shoring bracket and means for attaching the shoring bracket to a column in said building. The attaching means includes a support, in the form of a base and an arm extending outwardly from the base, and adjustable means received on the outwardly extending arm for mounting the shoring bracket on the arm. The adjustable mounting means includes a member affixed to the shoring bracket and having an aperture therethrough receiving the outwardly extending arm and generally conforming to the configuration of the arm. The adjustable mounting means also includes means for releasably holding the mounting means at predetermined positions along the outwardly extending arm.

12 Claims, 3 Drawing Figures

ADJUSTABLE APPARATUS FOR SUPPORTING CONCRETE FORMWORK

BACKGROUND OF THE INVENTION

This invention relates to apparatus for attaching a concrete formwork shoring bracket to a supporting column.

The prior art discloses several means for supporting concrete formwork during the construction of multi-story concrete buildings. Such means for supporting formwork, as used in pouring succeedingly higher floors in concrete buildings, has generally taken the form of fixed or movable scaffolding supported from the floor below upon which the formwork for the next floor is placed. This scaffolding on occasion has been provided with wheels or rollers such that, after completion of the floor for which the formwork has been used, the formwork may be moved laterally to the outside of the building and then raised to be placed in position for the next higher floor.

Other and more convenient means for supporting such concrete formworks are exemplified by column mounted shoring brackets, such as disclosed in U.S. Pat. No. 3,504,879 to Strickland and U.S. Pat. No. 3,815,858 to Mocny et al. With the brackets of these patents, the formwork no longer need be supported by scaffolding which rests upon the floor below and thus restricts working space. Instead, the brackets as disclosed in these patents may be attached to each of a row of supporting columns previously emplaced within the building, the attachment being effected by fastening the brackets onto studs cast into or attached to the columns. The shoring brackets attached to these columns then engage the concrete formwork to be used in constructing the floor above. Each column shoring bracket is vertically adjustable to permit alignment of the formwork. Additionally, the supporting heads of these prior art shoring brackets may be lowered such that the concrete formwork may rest upon a roller carried by the bracket and thus may be rolled out of position. While thse column shoring brackets provide substantial advantages by freeing the floor area beneath the concrete formwork from the clutter of scaffolding, they have suffered from the disadvantage that their only adjustment has been in the vertical direction, with no readily available lateral adjustment for positioning the shoring brackets preselected distances outwardly from the column upon which they are mounted. This lack of lateral adjustment outwardly from the column is a substantial disadvantage when there is misalignment of the columns forming a row upon which column shoring brackets are mounted. To provide the necessary precise lateral adjustment of a row of shoring brackets it has been necessary to use shims between the shoring bracket and the column to which it is mounted. Thus, the achievement of the required precise alignment has necessitated a tedious process of trial and error and has necessitated the availability of a substantial number of shims of varying thicknesses. Additionally, where the misalignment of the columns has been greater than the length of the attaching studs, no practical and relatively universal apparatus for mounting these general types of brackets has been available, other than the structure disclosed in Turner et al U.S. Pat. No. 3,776,499, and that structure may be limited in its utility under certain conditions. Accordingly, there has been a lack of satisfactory apparatus for supporting concrete formwork used in the construction of multi-story concrete buildings.

SUMMARY OF THE INVENTION

This invention provides apparatus for supporting concrete formwork used in the construction of multi-story concrete buildings, wherein a vertically adjustable formwork shoring bracket is attached to a column in such a building. The formwork supporting apparatus of this invention provides for ready adjustment and positioning of the shoring bracket predetermined distances outwardly of the supporting column. Briefly, the invention contemplates a shoring bracket having a vertically adjustable supporting surface for supporting vertical loads and means for attaching such a shoring bracket to a column in the building under construction. The formwork shoring bracket may conveniently provide for vertical adjustment and removal of the form in a manner similar to that provided by the shoring brackets disclosed in Strickland U.S. Pat. No. 3,504,879 or Mocny et al U.S. Pat. No. 3,815,858. The attaching means includes a support which is attachable to the supporting columns, and adjustable mounting means affixed to the shoring bracket and releasably attached to the support. The support has a base which is attachable to the supporting column and has an arm extending outwardly from the base. The adjustable mounting means includes a member affixed to the shoring bracket and received onto the outwardly extending arm, the member having an aperture therethrough receiving the arm and generally conforming to the configuration of the arm such that the member is supported against any substantial movement in any direction transversely of the arm. The mounting means also includes means for releasably holding the member at predetermined positions along the outwardly extending arm.

BRIEF DESCRIPTION OF THE DRAWINGS

The invention generally having been described, a specific embodiment will be discussed in detail with reference to the accompanying drawings in which.

DESCRIPTION OF AN ILLUSTRATED EMBODIMENT

Figure 1:
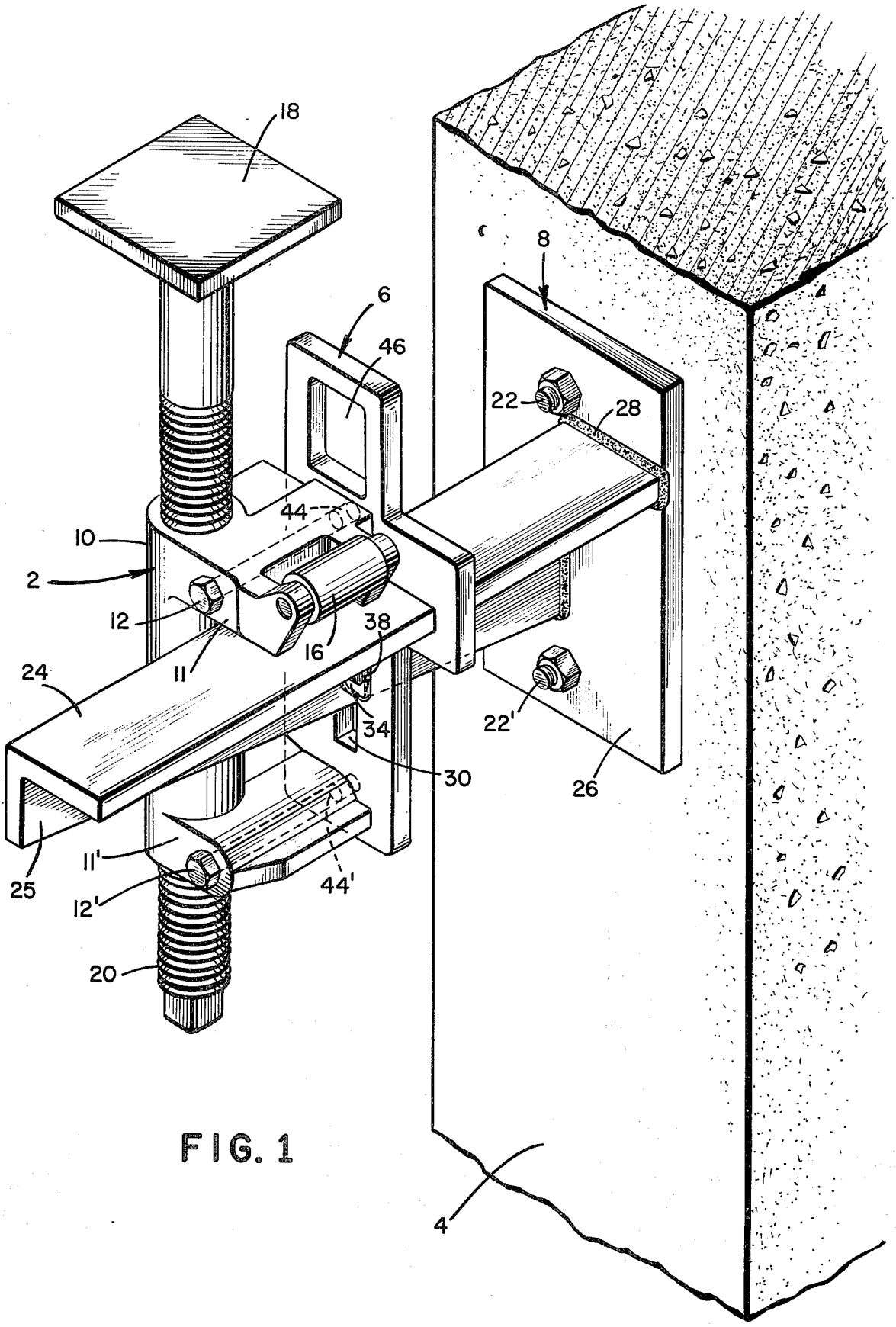
FIG. 1 is a perspective view of the adjustable attaching apparatus of this invention, including a concrete formwork shoring bracket.
Figure 2:
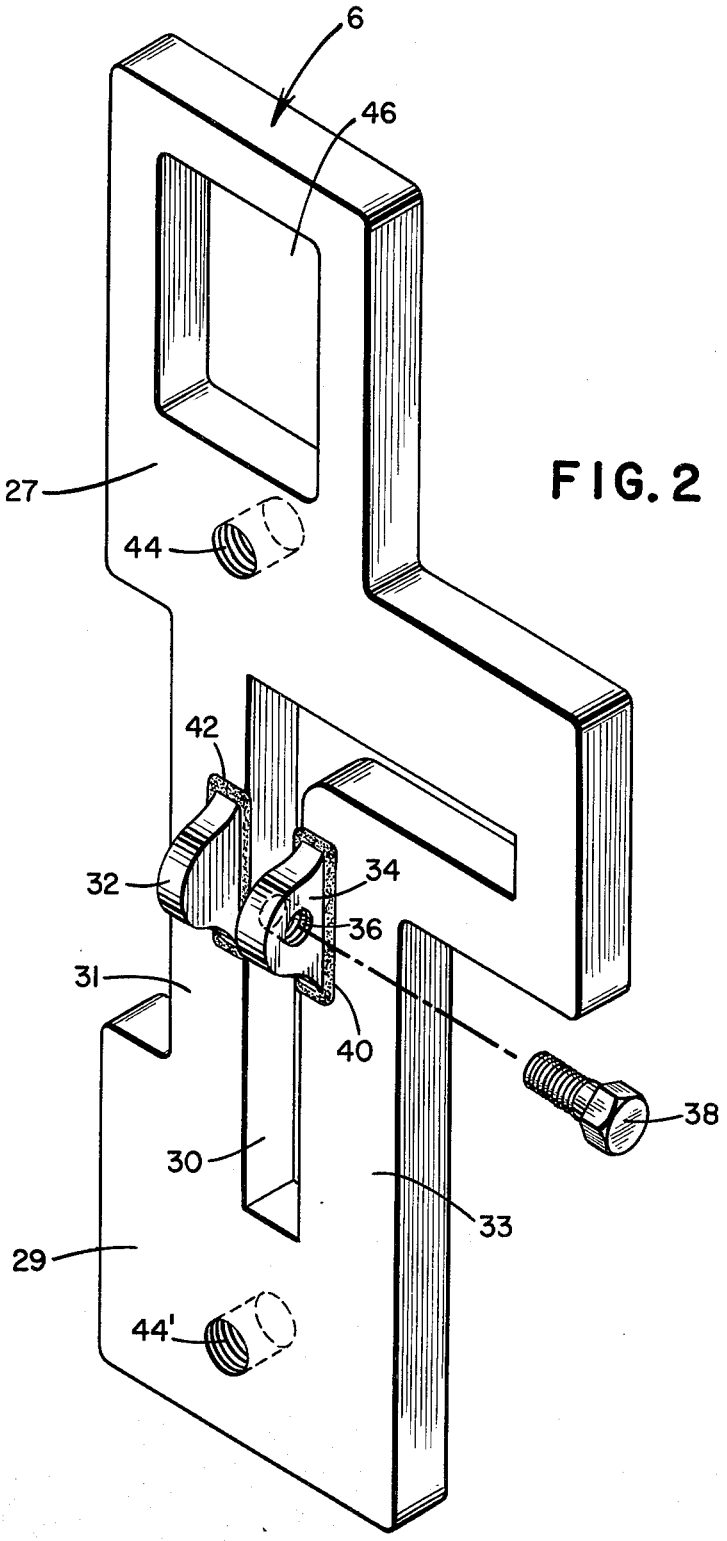
FIG. 2 is a perspective view of the adjustable mounting member of this invention.
Figure 3:
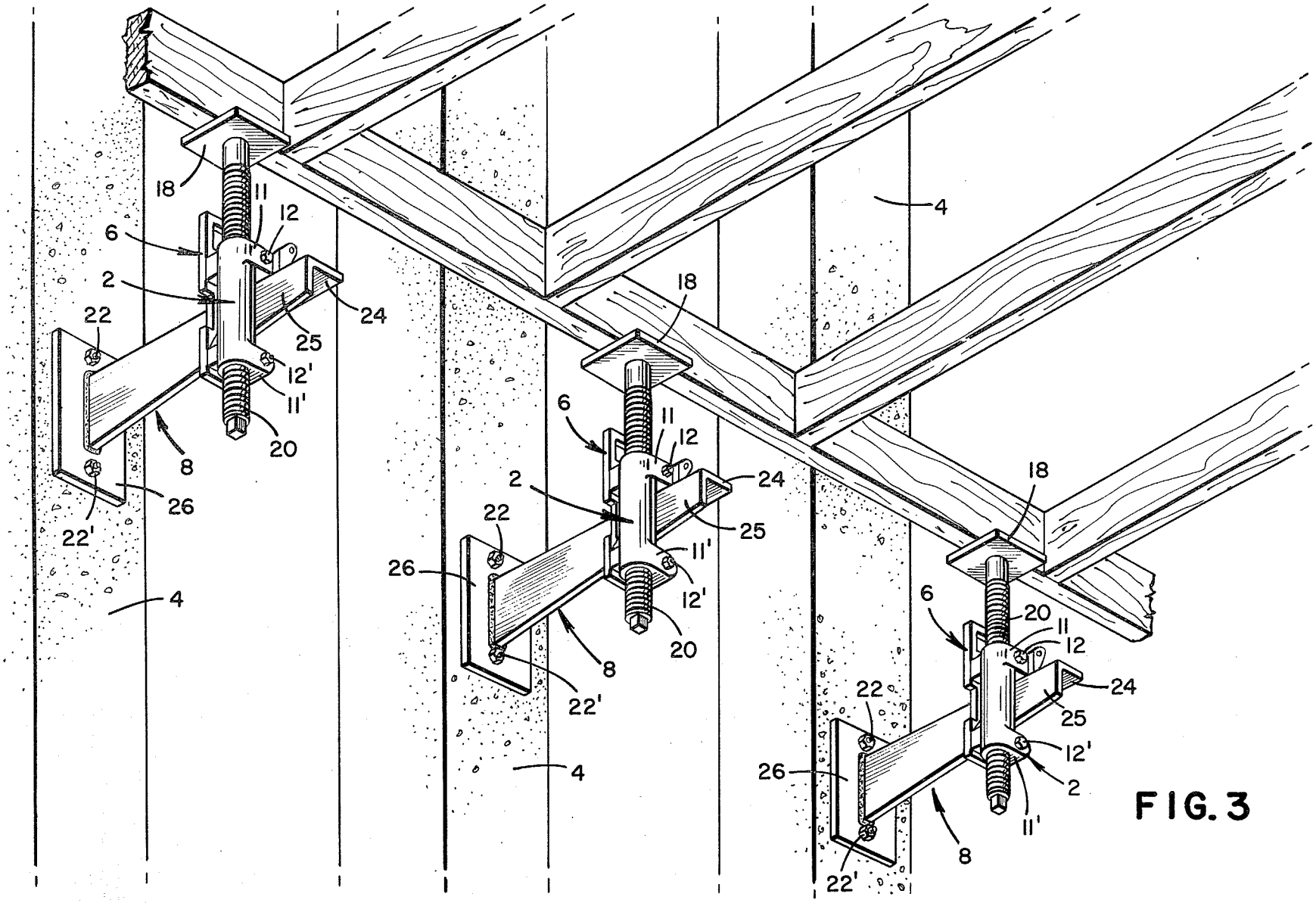
FIG. 3 is a fragmentary view of an installation using the apparatus of this invention, wherein concrete formwork is supported by shoring brackets attached to three substantially aligned columns by means of the adjustable attaching apparatus of this invention.

FIGS. 1, 2 and 3 illustrate one preferred embodiment of this invention which, for purposes of illustration, is represented as particularly suitable for use with the separate shoring bracket unit of Strickland U.S. Pat. No. 3,504,879. Other embodiments may be more suitable for use with other types of concrete formwork shoring brackets.

As shown in the embodiment of FIGS. 1, 2 and 3, the concrete formwork shoring bracket 2 may be attached to a supporting column 4 by affixing the shoring bracket 2 to adjustable mounting means, conveniently in the form of a member 6, which is carried by a support generally indicated by the reference number 8, and which, in turn, is attached to the column 4. This shoring bracket 2 includes an elongated body 10 having spaced upper and lower laterally extending projections 11 and 11', respectively, having provision for a pair of generally vertically aligned, releasable fasteners 12 and 12' or other means for affixing the shoring bracket 2 to the supporting column 4 or to other apparatus for attaching to the column 4. The shoring bracket 2 of this particular embodiment includes a roller 16 on the upper laterally extending projection 11, to facilitate removal of the formwork. Further, the shoring bracket 2 has a support head 18 to provide vertical support for the concrete formwork to be used, which support head 18 is vertically adjustable by means of screw jack 20 engaging screw threads with the body 10.

In a structure where it is intended to use column mounted shoring brackets of this type the structural supporting columns 4 are provided with studs 22 and 22' for attaching such shoring brackets 2 to the columns. These column attaching studs 22 and 22' are threaded and are cast into concrete columns or affixed to other types of columns, the studs being positioned to serve in the place of fasteners 12 and 12' for direct attachment of the shoring bracket to the column or to engage holes in other apparatus adapted to attach the shoring brackets to the columns as described hereinbelow.

In order to provide lateral adjustment for the precise alignment of individual brackets comprising a row of three or more formwork supports, as shown in FIG. 3, the shoring brackets 2 are attached, not directly to the studs 22 and 22', but to a laterally adjustable mounting member 6 which is carried by a support 8 attached to the column 4. The mounting member 6 may be positioned at any point outwardly of the column 4 along the arm 24 of the support 4, thus positioning the shoring bracket 2 at any corresponding preselected position outwardly of the column 4.

The support 8 includes a base plate 26, which may be attached to the column 4, and an outwardly extending arm 24 attached to the base plate 26. The arm 24 may conveniently have an inverted L-shaped cross section with an upwardly facing portion 23 and a side portion 25 and may be attached to the base by conventional means, such as weldments 28. Obviously, other structural configurations, for example, an I-beam, would be equally suitable for the outwardly extending arm 24.

The mounting member 6, shown in FIG. 2, may conveniently be fabricated from generally planar plate stock, such as 1/2 inch thick mild steel. Extending through this member 6 is an aperture 30 configured to conform generally to the configuration of the outwardly extending arm 24. In this illustrative embodiment the aperture 30 is depicted as conforming relatively closely to the cross-sectional configuration of the arm 24. However, the term generally conforming to the configuration of the outwardly extending arm is intended, within the scope of this embodiment, also to encompass such obvious variations as a triangular aperture having sides conforming generally to the upwardly facing portion 23 and side portion 25 of arm 24 and a third side extending between the extremities of the first two. Such variations are also contemplated with respect to other structural configurations of the arm 24. The aperture 30 may be configured and dimensioned to provide for easy, yet reasonably close fitting, reception of the mounting member 6 onto the arm 24 in the manner illustrated in FIG. 1. Thus, the mounting member 6 completely surrounds a segment of the arm 24 with integral upper and lower portions 27 and 29, respectively, above and below the aperture 30 and generally opposed side portions 31 and 33 on either side of the aperture. By means of the configurational relationships of the arm 24 and the aperture 30 the mounting member 6 is thus supported effectively against any substantial movement in any direction transversely of the arm 24.

On opposing side portions 31 and 33, and adjacent the slot 30 conveniently are provided ears 32 and 34 extending outwardly from the plane of the mounting member 6. One of these ears may desirably be provided with a tapped hole 36 therethrough for receiving a threaded fastener 38 thereinto to serve as a setscrew acting against the side portion 25 of the arm 24. The ears 32 and 34 may conveniently be formed as an integral part of member 6 or may be attached thereto by suitable means, such as weldments 40 and 42. The setscrew 38 provides for a releasable clamping action to hold the member 6 at preselected positions along arm 24. Of course, where other provision is made for holding the member 6 at such preselected positions, the ears and setscrew may, if desired, be eliminated.

The adjustably positionable mounting member 6 also includes means for affixing the concrete formwork shoring bracket thereto, desirably in the form of tapped holes 44 and 44' positioned suitably in the upper and lower portions 27 and 29, respectively, of the member 6 and dimensioned threadedly to receive the vertically aligned fasteners 12 and 12' extending through formwork shoring bracket projections 11 and 11', as illustrated in FIG. 1. These holes 44 and 44' may desirably be positioned to place the upper and lower projections 11 and 11' of the shoring bracket respectively above and below the arm 24 and to permit the underside of the projection 14 of the shoring bracket 2 to rest on the upwardly facing portion 23 of the arm 24 when the entire structure is assembled as in FIG. 1. The position of these holes desirably may also be chosen to provide for engagement of the body 10 of the shoring bracket 2 against the side portion 25 of the arm 24. Assembled in this manner the shoring bracket 2 may thus derive both vertical and horizontal support directly from the surfaces of the arm 24, and the two fasteners 12 and 12' may effectively hold the shoring bracket against any rotation with respect to the member 6. Similar benefits within the scope of this invention may be obtained by non-releasably affixing the shoring bracket 2 to the member 6, such as by welding the two structures together.

The upper portion 27 of the mounting member 6 suitably may be provided with an aperture 46 which may serve both to lighten the weight of the member 6 and to provide convenient means for grasping and carrying the structure. This member 6 may also be configured with the upper portion 27 of sufficient height that, when used with a shoring bracket of the general type illustrated, upper portion 27 extends above the level of the top of the roller 16 of the shoring bracket. Thus, at any time that the vertically adjustable support head 18 of the shoring bracket 2 is lowered below the level of the uppermost part of the roller 16, formwork which is supported by the shoring bracket (in such case, resting on roller 16) may be restrained laterally against movement toward the column 4 by the upwardly extending portion 27 of the member 6. Similar benefits may also be received when the apparatus of this invention is used with other types of concrete formwork shoring brackets.

In practice, the mounting apparatus of this invention may be used in the construction of any concrete structure where it is necessary to support overhead formwork and where there are rows of vertical supporting columns available for attaching formwork shoring brackets thereto. The apparatus of this invention is entirely suitable for use where the columns of the row are in precise alignment with one another and where it is desired to place the shoring brackets immediately adjacent such columns. However, this invention is particularly useful and convenient where lateral adjustment of the shoring brackets outwardly of the column is desired, and especially where such adjustment is necessary to correct for slight misalignment of the columns comprising the row, in order that all the shoring brackets of the row may support the proper members of the formwork. The precedure for such use may be as follows. Firstly, a support 8 is attached to each column 4 which is intended to support the formwork, by means of the fasteners 22 and 22' affixed to the column 2. Secondly, a mounting member 6 is received onto each arm 24 and is clamped at any desired position therealong by means of setscrew 38. Thirdly, a formwork shoring bracket 2 is affixed to the mounting member 6 by means of fasteners 12 and 12'. Fourthly, the clamping means, in the form of setscrews 38, of the mounting members 6 are released as necessary and the shoring bracket/mounting member combinations on the columns of the row are moved to the positions necessary for mutual alignment. Lastly, the clamping means 38 of the mounting members 6 are again secured to their respective support arms 24, thus rendering the row of formwork shoring brackets ready for use.

The foregoing is considered as illustrative only of the principals of the invention. Numerous modifications and changes within the scope of the invention will readily occur to those skilled in the art. Such modifications and changes may include, without limitation, the incorporation of the adjustable mounting means and the shoring bracket into a unitary structure, configurational changes of both the outwardly extending arm and the adjustable mounting means, application of the invention to other types of formwork shoring brackets, and other variations of the structure. Accordingly, it is intended not to limit the invention to the exact construction and operation shown and described but to include all modifications and changes thereto falling within the scope of the claims appended hereto.

We claim:

1. Apparatus for supporting concrete formwork used in construction of multi-story concrete buildings, said apparatus comprising in combination:

a formwork shoring bracket having a vertically adjustable supporting surface for supporting vertical loads, and attaching means for attaching said shoring bracket to a column in said building, said attaching means comprising a support comprising a base and an arm extending outwardly from said base, said base being attachable to said supporting column and said arm having at least one generally upwardly facing planar surface and one generally horizontally outwardly facing planar surface, and adjustable mounting means received on said outwardly extending arm, said adjustable mounting means comprising a generally planar member affixed to said shoring bracket and having an aperture therethrough receiving said outwardly extending arm, said member having upper and lower portions and a pair of side portions integral therewith and surrounding said aperture, said aperture generally conforming to the configuration of said outwardly extending arm such that said member matingly engages both said generally upwardly facing planar surface and said generally horizontally outwardly facing side portion surface to support said member against any substantial movement in any direction transversely of said arm and against any rotation about said arm, said mounting means further including means for releasably holding said member at predetermined positions along said outwardly extending arm.

2. The apparatus of claim 1 wherein said member is releasably affixed to said shoring bracket.

3. The apparatus of claim 1 wherein said member further includes at least two spaced, releasable affixing means for affixing said shoring bracket to said member.

4. The apparatus of claim 1 wherein said shoring bracket comprises upper and lower laterally extending projections extending, respectively, above and below said arm, said upper projection being releasably affixed to said upper portion of said member and said lower projection being releasably affixed to said lower portion of said member.

5. The apparatus of claim 4 wherein said upper and lower projections are releasably affixed to said upper and lower portions of said member at generally vertically aligned locations.

6. The apparatus of claim 1 wherein said outwardly extending arm has a generally upwardly facing portion engageable with a portion of said concrete formwork shoring bracket.

7. The apparatus of claim 1 wherein said outwardly extending arm has a side portion engageable with a portion of said concrete formwork shoring bracket.

8. A support system for attaching concrete formwork used in the construction of multi-story concrete buildings to a row of at least three generally aligned columns, said system comprising for each of said columns a formwork shoring bracket having a vertically adjustable supporting surface for supporting vertical loads, and attaching means for attaching said shoring bracket to a column in said building, said attaching means comprising a support comprising a base and an arm extending outwardly from said base, said base being attachable to said supporting column and said arm having at least one generally upwardly facing planar surface and one generally horizontally outwardly facing planar surface, and adjustable mounting means received on said outwardly extending arm, said adjustable mounting means comprising a generally planar member affixed to said shoring bracket and having an aperture therethrough receiving said outwardly extending arm, said member having upper and lower portions and a pair of side portions integral therewith and surrounding said aperture, said aperture generally conforming to the configuration of said outwardly extending arm such that said member matingly engages both said generally upwardly facing planar surface and said generally horizontally outwardly facing side portion surface to support said member against any substantial movement in any direction transversely of said arm and against any rotation about said arm, said mounting means further including means for releasably holding said member at predetermined positions along said outwardly extending arm, whereby each said shoring bracket may be positionable at predetermined distances outwardly from the column on which it is mounted such that three or more shoring brackets may be positioned in precise lateral alignment with one another despite slight misalignment of said three or more columns.

9. Apparatus for supporting concrete formwork used in construction of concrete structures, said apparatus comprising in combination:

a formwork shoring bracket having a vertically adjustable supporting surface for supporting vertical loads, and attaching means for attaching said shoring bracket to an upright structural componnent in said structure, said attaching means comprising a support comprising a base and an arm extending outwardly from said base, said base being attachable to said upright structural component and said arm having at least one generally upwardly facing planar surface and one generally horizontally outwardly facing planar surface, and adjustable mounting means received on said outwardly extending arm, said adjustable mounting means comprising a generally planar member affixed to said shoring bracket and having an aperture therethrough receiving said outwardly extending arm, said member having upper and lower portions and a pair of side portions integral therewith and surrounding said aperture, said aperture generally conforming to the configuration of said outwardly extending arm such that said member matingly engages both said generally upwardly facing side portion surface to support said member against any substantial movement in any direction transversely of said arm and against any rotation about said arm, said mounting means further including means for releasably holding said member at predetermined positions along said outwardly extending arm.

10. The apparatus of claim 1 wherein said outwardly extending arm has a generally upwardly facing portion engageable with a portion of said concrete formwork shoring bracket.

11. The apparatus of claim 1 wherein said outwardly extending arm has a side portion engageable with a portion of said concrete formwork shoring bracket.

12. A support system for attaching concrete formwork used in the construction of concrete structures to at least three upright and generally aligned structural component portions, said system comprising for each of said upright structural component portions a formwork shoring bracket having a vertically adjustable supporting surface for supporting vertical loads, and attaching means for attaching said shoring bracket to an upright structural component portion in said structure, said attaching means comprising a support comprising a base and an arm extending outwardly from said base, said base being attachable to said upright component portion and said arm having at least one generally upwardly facing planar surface and one generally horizontally outwardly facing planar surface, and adjustable mounting means received on said outwardly extending arm, said adjustable mounting means comprising a generally planar member affixed to said shoring bracket and having an aperture therethrough receiving said outwardly extending arm, said member having upper and lower portions and a pair of side portions integral therewith and surrounding said aperture, said aperture generally conforming to the configuration of said outwardly extending arm such that said member matingly engages both said generally upwardly facing planar surface and said generally horizontally outwardly facing side portion surface to support said member against any substantial movement in any direction transversely of said arm and against any rotation about said arm, said mounting means further including means for releasably holding said member at predetermined positions along said outwardly extending arm, whereby each said shoring bracket may be positionable at predetermined distances outwardly from the upright component portion on which it is mounted such that three or more shoring brackets may be positioned in precise lateral alignment with one another despite slight misalignment of said three or more upright component portions.

* * * * *